US008511511B2

(12) United States Patent
Thoren et al.

(10) Patent No.: US 8,511,511 B2
(45) Date of Patent: Aug. 20, 2013

(54) DISPENSER FOR A CENTER-FED ROLL OF WEB MATERIAL

(75) Inventors: Agneta Thoren, Molnylcke (SE); Joachim Glatzl, Gothenburg (SE)

(73) Assignee: SCA Hygiene Products AB, Gothenburg (SE)

( * ) Notice: Subject to any disclaimer, the term of this patent is extended or adjusted under 35 U.S.C. 154(b) by 0 days.

(21) Appl. No.: 12/522,759

(22) PCT Filed: Jan. 12, 2007

(86) PCT No.: PCT/SE2007/000024

§ 371 (c)(1),
(2), (4) Date: Jul. 10, 2009

(87) PCT Pub. No.: WO2008/085090

PCT Pub. Date: Jul. 17, 2008

(65) Prior Publication Data

US 2010/0001015 A1 Jan. 7, 2010

(51) Int. Cl.

| | |
|---|---|
| ***A47K 10/38*** | (2006.01) |
| ***A47K 10/36*** | (2006.01) |
| ***A44B 19/00*** | (2006.01) |
| ***A44B 18/00*** | (2006.01) |

(52) U.S. Cl.
USPC ..... 221/63; 221/26

(58) Field of Classification Search
USPC ..... 221/26, 33, 45, 47, 61, 63, 154, 303, 221/307, 308
See application file for complete search history.

(56) References Cited

U.S. PATENT DOCUMENTS

| | | | | |
|---|---|---|---|---|
| 2,664,933 | A * | 1/1954 | Gielow | 206/315.5 |
| 2,875,869 | A | 3/1959 | Friedman | |
| 3,002,668 | A * | 10/1961 | Castelli | 225/52 |
| 3,868,052 | A * | 2/1975 | Rockefeller | 225/106 |
| 4,138,034 | A * | 2/1979 | McCarthy | 221/48 |
| 5,427,453 | A | 6/1995 | Cloessner | |
| 6,578,731 | B1 | 6/2003 | Lewis | |

(Continued)

FOREIGN PATENT DOCUMENTS

FR 2549362 1/1985

OTHER PUBLICATIONS

International Search Report dated Sep. 12, 2007, in PCT application.

(Continued)

*Primary Examiner* — Gene Crawford
*Assistant Examiner* — Kevin L Randall, Jr.
(74) *Attorney, Agent, or Firm* — Drinker Biddle & Reath LLP

(57) ABSTRACT

A dispenser for a center-fed roll of web material in the form of tissue paper or nonwoven material has a dispenser opening which preferably has an elongated shape wherein one side edge is provided with tearing elements and the opposite side edge is smooth and free from tearing elements, and wherein the length of the dispenser opening is between 40 and 90% of the roll diameter and the width of the dispenser opening is at least 10 times the thickness of the web material and at least 5 mm, but no more than 40 mm. Preferably the dispenser is portable, wherein at least a substantial part of the dispenser is made of a moisture and tear resistant flexible material adapted for multiple use and the dispenser further includes a reclosable opening through which the roll of web material may be inserted into the dispenser.

22 Claims, 4 Drawing Sheets

(56) References Cited

U.S. PATENT DOCUMENTS

| | | | | |
|---|---|---|---|---|
| 6,834,773 | B2 * | 12/2004 | Wu | 221/45 |
| 7,578,414 | B2 * | 8/2009 | Sellars et al. | 221/65 |
| 2004/0251292 | A1 * | 12/2004 | Grebonval et al. | 225/39 |
| 2005/0211717 | A1 * | 9/2005 | Decker et al. | 221/63 |
| 2011/0253761 | A1 * | 10/2011 | Glatzl | 225/53 |
| 2012/0256037 | A1 * | 10/2012 | Nordlund | 242/560 |

OTHER PUBLICATIONS

RU Office Action, dated Oct. 21, 2010, in Application No. 2009130731.

* cited by examiner

DISPENSER FOR A CENTER-FED ROLL OF WEB MATERIAL

TECHNICAL FIELD

The present invention refers to a dispenser for a roll of web material in the form of tissue paper or nonwoven material intended for wiping purposes, wherein the web material is extracted from the centre of the roll. The dispenser comprises an elongated housing for accommodating the roll, said housing having an end wall at each end and a dispenser opening is arranged in at least one end wall of the dispenser. The dispenser opening is provided with tearing means for tearing off a portion of the web material. In a further aspect the invention refers to a portable dispenser.

BACKGROUND OF THE INVENTION

Dispensers of this kind are frequently used in private households and on different kinds of public premises such as toilets, restaurants, hospitals, industries etc. The dispenser may be mounted on a wall or other support in a vertical or horizontal position with the dispenser opening in coaxial alignment with the longitudinal axis of the enclosed roll. It may also be portable to be carried along. Both for stationary and portable dispensers the paper web is extracted in the direction of the longitudinal axis of the roll and is torn against the tearing means, such as a toothed edge, of the dispenser opening. Dispensing the paper from the centre of the roll has several advantages as compared to unwinding the paper from the periphery of the roll, since the roll can remain stationary in the dispenser and the only thing that needs to be displaced is the pulled out length of paper web.

WO 81/02880 discloses a stationary dispenser for centre-fed paper rolls, where the web is extracted at the upper end of the dispenser. The web path is first straight upwards and is then drawn around an edge portion to exit the dispenser through a dispenser opening located at the side of the dispenser. The dispenser opening has tearing means for tearing off desired lengths of the paper web.

SE-C-519 199 discloses a single use portable dispenser for a centre-fed paper roll. The dispenser comprises a casing, for example a plastic film, enclosing the roll and provided with a dispenser opening in one end wall. The dispenser opening has a substantially round or square configuration and comprises tearing means.

JP-A-2003-290074 discloses a portable dispenser for a toilet paper roll where the paper roll is unwound from its periphery and the paper web is drawn out through a dispenser opening in the side wall of the dispenser. The dispenser opening is provided with a tear bar.

U.S. Pat. No. 3,002,668 discloses a portable dispenser for relatively thick bands of fluffy fibrous materials, especially cotton in strip form. The cotton strips are folded in a zigzag configuration and is withdrawn from the dispenser through a dispenser opening in a top wall of the dispenser. The dispenser opening is elongated and has one relatively smooth longitudinal side and one longitudinal side provided with a plurality of teeth. The width of the dispenser opening is approximately equal to or slightly less than the thickness of the cotton strip, so that the strip is prevented from falling back into the dispenser after a length of strip material has been torn off.

SUMMARY OF THE INVENTION

An object of the present invention is to provide a dispenser for a centre-fed roll of web material in the form of tissue paper or nonwoven material of the kind specified above, wherein a desired length of web material may be easily withdrawn from the dispenser without risk for breaking and when the desired length has been withdrawn the web material may be torn off against the tearing means. The dispenser opening should further be designed in a manner that the roll is prevented from falling out therethrough also when the remaining amount of web material is very small, said remaining web material being in the form of a thin rim, that easily can collapse and fall or be pulled out of the dispenser opening if this is too large.

These objects have been accomplished by the fact that said dispenser opening has an elongated shape having a length in longitudinal direction and a width in transverse direction and a pair of opposed longitudinal side edges, wherein one longitudinal side edge is provided with said tearing means and the opposite longitudinal side edge is smooth and free from tearing means, and wherein the length of the dispenser opening is between 40 and 90% of the roll diameter and the width of the dispenser opening is at least 10 times the thickness of the web material and at least 5 mm, but not more than 40 mm.

In a further aspect of the present invention there is provided a portable dispenser for a centre-fed roll of web material in the form of tissue paper or nonwoven material, the dispenser comprising an elongated housing for accommodating the roll, said housing having an end wall at each end covering the respective end surface of the roll, wherein a dispenser opening is arranged in at least one end wall of the housing, said dispenser opening being provided with tearing means. The portable dispenser should be adapted for multiple use with easy refill with a new roll. It should further be possible to store the empty portable dispenser in a space-saving manner. This has according to the present invention been provided by the fact that at least a substantial part of the dispenser is in the form of a casing made of a moisture and tear resistant flexible material in the form of a textile and/or plastic material adapted for multiple use and that the dispenser further comprises a reclosable opening through which the roll of web material may be inserted into the dispenser, said opening being provided with refastenable adhesive or mechanical closure means for closing the opening.

Further features of the dispenser according to the invention are found in the dependant claims and in the following description.

DEFINITIONS

Tissue Paper

The term tissue paper refers to soft absorbent paper having a basis weight below 65 g/m$^2$ and typically between 10 and 50 g/m$^2$. Its density is typically below 0.60 g/cm$^3$, preferably below 0.30 g/cm$^3$ and more preferably between 0.08 and 0.20 g/cm$^3$. The tissue paper may be creped or non-creped. The creping may take place in wet or dry condition. It may further be foreshortened by any other methods, such as so called rush transfer between wires.

The fibers contained in the tissue paper are mainly pulp fibers from chemical pulp, mechanical pulp, thermo mechanical pulp, chemo mechanical pulp and/or chemo thermo mechanical pulp (CTMP). The fibers may also be recycled fibers. The tissue paper may also contain other types of fibers enhancing e.g. strength, absorption or softness of the paper. These fibers may be made from regenerated cellulose or synthetic material such as polyolefins, polyesters, polyamides etc.

The tissue paper coming out from the tissue paper machine may comprise one or more layers. In the case of more than one layer this is accomplished either in a multi-layered headbox, by forming a new layer on top of an already formed layer or by couching together already formed layers. These layers can not or only with considerable difficulty be separated from each other and are joined mainly by hydrogen bonds. The different layers may be identical or may have different properties regarding for example fibre composition and chemical composition.

A paper comes out from the paper machine as a single-ply paper sheet, which later in the converting process can be combined with other plies by a lamination process, such as gluing and or embossing, to form a multi-ply material. The same applies to a nonwoven material. A single ply may comprise one, two or more layers, obtained by any of the methods mentioned above. Embossing of a paper will increase the thickness of the paper, so that its thickness as measured between the tips of the protruding embossings on opposite sides of the paper is larger than the thickness of the paper web as such.

The main use of tissue paper is as toilet and kitchen paper, paper towels, handkerchiefs, wiping material and the like.

Nonwoven

A nonwoven material is defined as a manufactured sheet, web or batt of directionally or randomly orientated fibres, bonded by friction and/or melt-bonding and/or cohesion and/or adhesion. The fibres may be of natural or man-made origin. They may be staple fibres or continuous filaments or be formed in situ. Examples of nonwoven materials are hydroentangled materials, spunbonded webs, meltblown webs, carded bonded webs, airlaid bonded webs, wetlaid webs, thermobonded webs, through-air-bonded webs etc. The nonwoven materials referred to in the present invention are intended for wiping purposes and have a basis weight between 10 and 100 g/m$^2$.

Thickness of Web Material

The thickness of the web material is measured according to the European standard EN-ISO 12625-3:2005.

BRIEF DESCRIPTION OF THE DRAWINGS

The invention will below be described with reference to the accompanying drawings, in which.

DETAILED DESCRIPTION OF PREFERRED EMBODIMENTS

Figure 1:
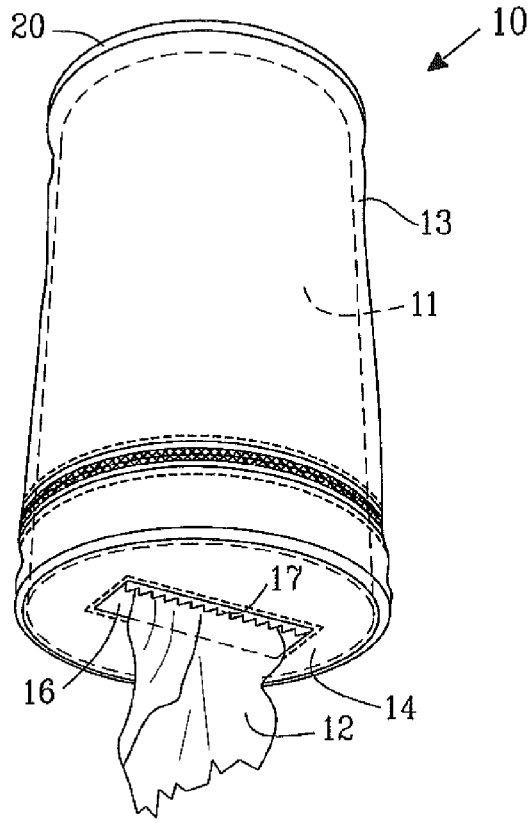
FIGS. 1 and 2 are perspective views shown from different sides of one embodiment of a portable dispenser according to the invention.
Figure 2:
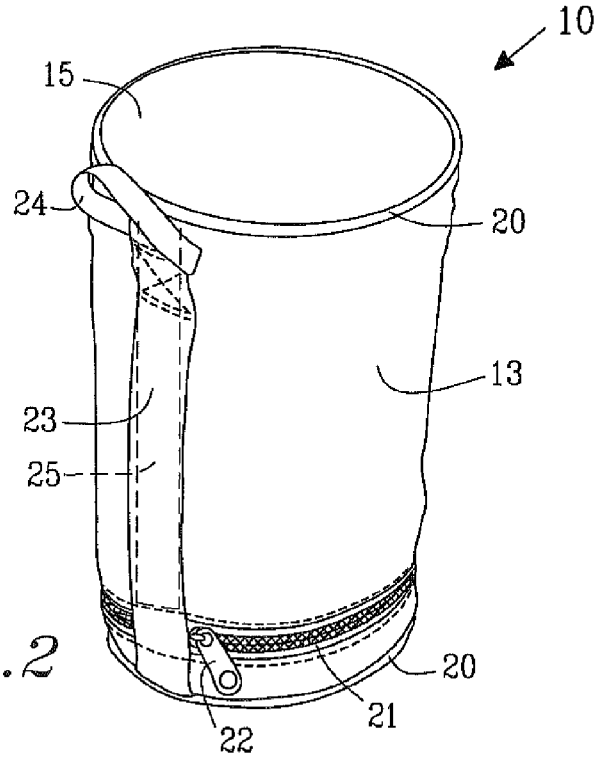
Figure 3:
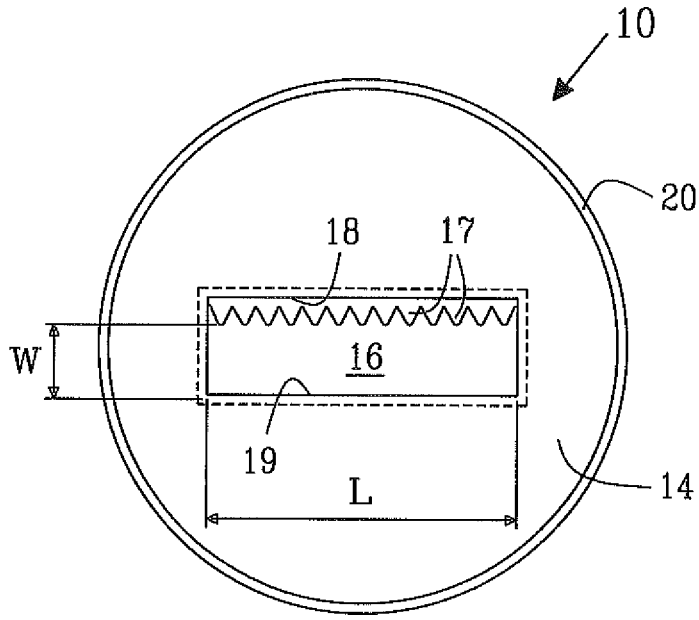
FIG. 3 is an end view of the dispenser in FIGS. 1 and 2 showing the dispenser opening.

FIGS. 1 and 2 show a portable dispenser 10 for a roll 11 of web material 12 in the form of tissue paper or nonwoven material intended for wiping purposes. The roll 11 is indicated with dashed lines in FIG. 1 and shown in more detail in FIG. 4. The web material 12 is extracted from the centre of the roll and the roll is therefore referred to as a centre-fed roll contrary to a roll where the web material is unwound from the periphery of the roll. The dispenser 10 comprises an elongated housing 13 in the shape of a casing accommodating the roll, said housing having an end wall 14, 15 at each end and a dispenser opening 16 arranged in one end wall 14 of the dispenser. The dispenser opening is provided with tearing means 17 in the form of a toothed edge for tearing off the web material in desired lengths.

Figure 4:
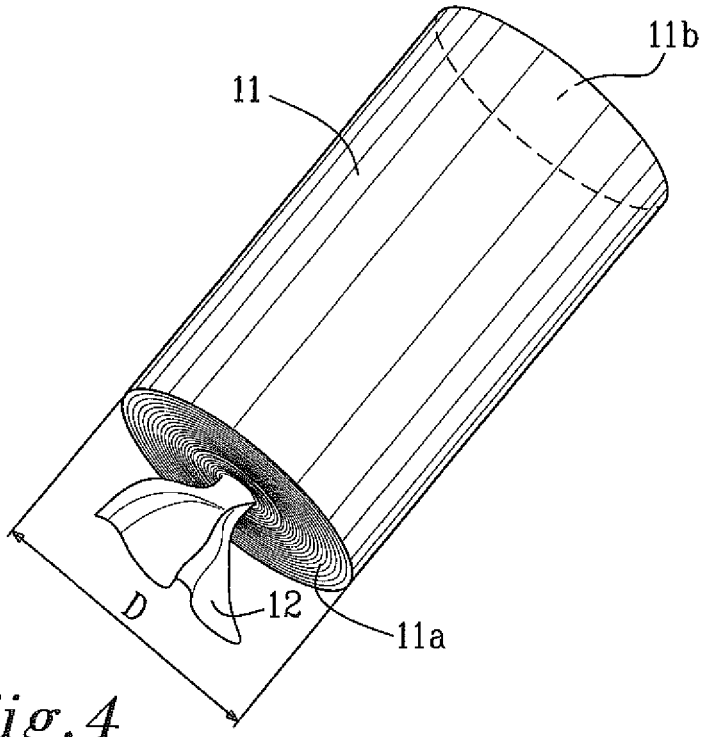
FIG. 4 is a perspective view of a centre-fed roll of web material.

The web material generally has a basis weight between 10 and 100 g/m$^2$ and a thickness from 10 to 1000 μm. The tensile strength of the web material should preferably be below 800 N/m, more preferably below 600 N/m, so that it may easily be torn off against the tearing means. The roll 11 has a diameter, D, as measured before web material has been extracted therefrom. The roll has a length and an end surface 11*a* and 11*b* at each end, as shown in FIG. 4. In the following the web material will be referred to as "paper". In some embodiments the web material may be perforated at intervals in order to facilitate cutting off, however in most cases when using a dispenser having tearing means as disclosed such perforation is redundant.

The dispenser opening 16 has an elongated shape and a length, L, in longitudinal direction and a width, W, in transverse direction. It has a pair of opposed side edges 18 and 19, wherein one side edge, 18, is provided with said tearing means 17 and the opposite side edge 19 is smooth and free from tearing means. The dispenser opening 16 including the tearing teeth 17 lies in the same plane as the substantially plane end wall 14, which means that the tips of the tearing teeth are directed toward the centre of the dispenser opening. This involves that the end wall 14 having the dispenser opening therein will be substantially plane and may therefore easily be put on a plane surface, such as a table, floor etc.

Figure 5:
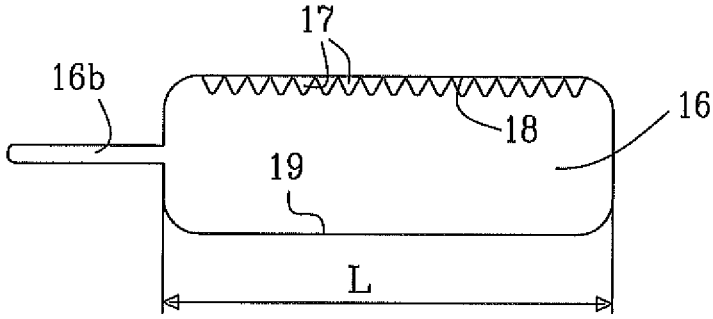
FIG. 5 is a plan view of a modified dispenser opening.

The elongated dispenser opening 16 may be rectangular as shown in FIG. 1 or of another optional elongated shape. One example of another elongated dispenser opening 16 is shown in FIG. 5, which has a narrow slot 16*b* at one end in which the paper may be locked. In an alternative embodiment one or both side edges 18 and 19 may have a curved shape.

The width, W, of the dispenser opening 16 is measured from the tip of the tearing teeth 17 to the opposed smooth side edge 19. In case the width of the dispenser opening varies along the length of the dispenser opening, the width, W, as referred to herein, is the width at the broadest portion of the dispenser opening.

The length, L, of the dispenser opening 17 should be between 40 and 90% of the roll diameter, D. For a roll having a diameter, D, of 12 cm this means that the length, L, of the dispenser opening 17 should be between 4.8 and 10.8 cm. Preferably the length, L, of the dispenser opening 17 is between 50 and 80% of the roll diameter, D.

Since the paper comes out from a centre-fed roll in the form of a twisted strip which has a thickness of a plurality of plies of paper the width, W, of the dispenser opening should be at least 10 times the thickness of the paper web, and at least 5 mm. The dispenser opening should have a width of not more than 40 mm.

For a paper web having a thickness of for example 600 μm the width, W, should be at least 6 mm. Embossed paper such as used in kitchen rolls may have thickness of up to 1 mm. Preferably the width, W, is at least 15 times the thickness of the web material, and at least 8 mm and more preferably at least 10 mm. Preferably the width, W, is not more than 40 mm.

The design and dimensions of the dispenser opening 16 ensure that the paper can be easily pulled out against the smooth side edge 19 out of contact with the tearing teeth 17 at the opposite side of the dispenser opening, so that the risk for unintentional breaking of the paper is avoided. It is further avoided that the roll unintentionally falls out through the dispenser opening also when the remaining amount of web material is very small.

When a desired length of paper has been pulled out, the paper web is directed against the opposite side 18 of the dispenser opening so that it is pulled against the tearing teeth 17 and torn off.

FIGS. 1 and 2 show a portable dispenser intended for multiple use, wherein the paper roll is easily replaced. The dispenser has the shape of a casing adapted to the size of the roll. In the embodiment shown said casing has a substantially cylindrical shape with a pair of plane end walls 14 and 15. At least a substantial part of the casing 13 is of a flexible material. A "substantial part" herein means that at least 50%, preferably at least 70%, of the material in the casing is flexible. Especially the side walls should preferably be flexible, while the end walls 14 and 15 may be flexible or rigid.

In an empty state the dispenser may then be folded together and stored in a space saving condition. In one embodiment the entire dispenser is made of said flexible material, and rigid plates are attached to the inside of the plane end walls 14 and 15, to make these rigid.

The flexible material is preferably a moisture and tear resistant flexible material adapted for multiple uses. Preferably the flexible material is a textile material, a plastic material or combinations thereof. Examples of moisture and tear resistant textile materials are different types of polyester materials. A backing or lining of for example plastic material or another textile material may further be provided. In order to provide an improved stability to the casing 13 a braid 20 of a suitable material, for example plastic material, may be provided between the side walls and the respective end walls.

The material in the tearing teeth 17 should be a hard and durable material, such as metal or a suitable hard plastic material.

The casing 13 is further provided with a reclosable opening 21 through which the roll of web material may be inserted into the dispenser. The reclosable opening 21 is provided with a zipper 22 or other mechanical closure means, such as hook and loops, Velcro® or the like. The closure means 22 may also be of refastenable adhesive material.

The reclosable opening 21 preferably extends in a circumferential direction around at least 80% of the circumference of the dispenser so that the paper roll is easily inserted into the dispenser. The location of the reclosable opening 21 is preferably at a distance of no more than 5 cm from an end wall 14 or 15 thereof, and preferably from the end wall 14 having the dispenser opening 16 therein.

The portable dispenser shown in FIGS. 1 and 2 has a carrying handle 23 attached thereto, so that the dispenser may be easily carried along to places where the paper is needed, and a loop 24 for hanging the dispenser on a hook or the like. The carrying handle 23 allows the dispenser to be carried in one hand and the paper may be pulled out and cut off against the tearing teeth 17 with the opposite hand.

In the embodiment shown the carrying handle 23 extends in a longitudinal direction of the dispenser along a substantial part thereof, which means at least 50% and preferably at least 75% of the length of the dispenser. A rigid strip 25 is attached to the flexible walls of the dispenser just opposite the carrying handle 23, said strip also extends in the longitudinal direction of the dispenser. The rigid strip 25 prevents collapse of the flexible walls when carrying the dispenser also when the remaining amount of paper in the dispenser is very small, and there is no paper roll left in the dispenser which is stiff enough to provide any stiffening effect.

The carrying handle 23 may of course be attached to the dispenser in other locations, for example across one end wall 14, 15 thereof.

The different parts of the dispenser, such as tearing means 17, carrying handle 23, rigid strip closure means 22 etc. may be sewn to the flexible material forming the walls of the dispenser or attached thereto in other suitable manner, such as by adhesive or by heat sealing.

Figure 6:
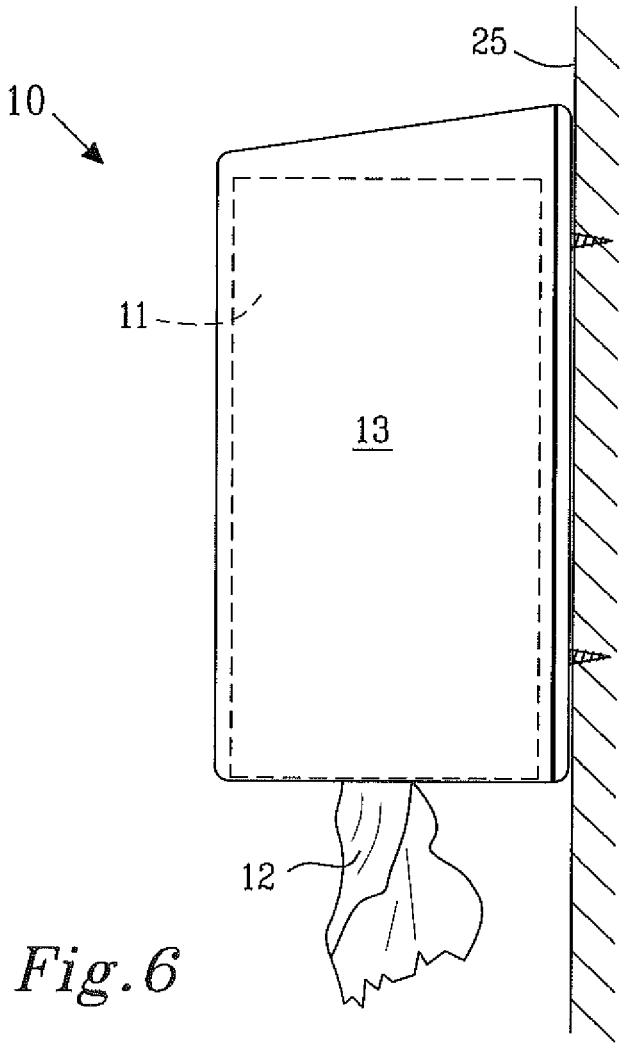
FIG. 6 is a perspective view of an embodiment of a fixed wall-mounted dispenser.
Figure 7:
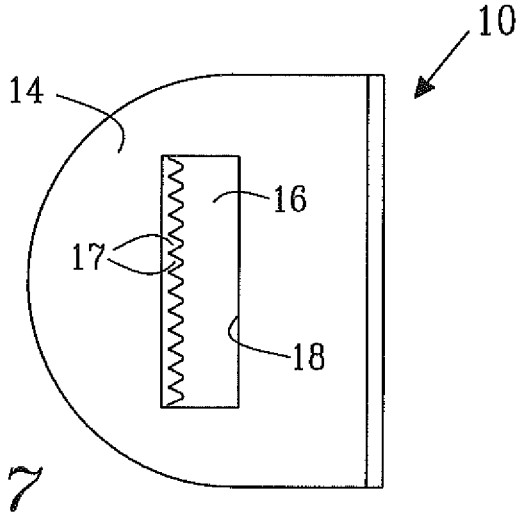
FIG. 7 is an end view of the dispenser in FIG. 6 showing the dispenser opening.

FIG. 6 shows an example of stationary dispenser mounted on a wall 25. Such dispensers usually are of rigid material and are openable in order to replace the paper roll. The dispenser may be opened in different ways, such as by a top lid or by making the front, top and side walls of the dispenser as an integrated unit which is hingedly connected to the rear wall of the dispenser. The dispenser in FIG. 6 is provided with a dispenser opening 16 of the kind described above and as shown in FIG. 7.

Figure 8:
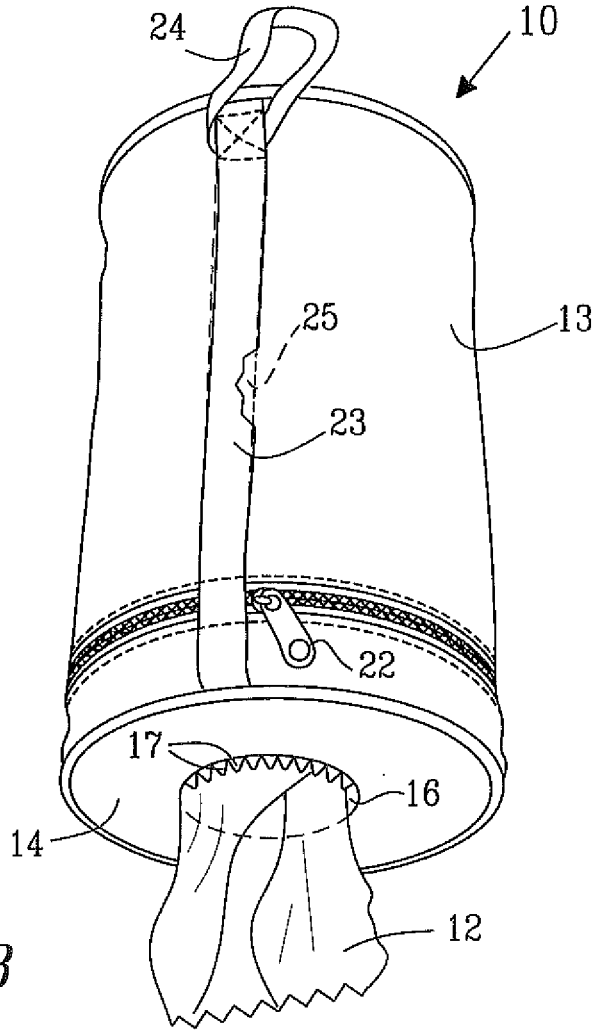
FIG. 8 is a perspective view of a still further embodiment of a portable dispenser according to the invention having another type of dispenser opening.

FIG. 8 shows a portable dispenser of the type described above, but with another kind of dispenser opening 16, in this case a circular opening with tearing teeth 17 around part of the circumference and a smooth edge around the rest of the circumference of the opening. The portable dispenser may however be provided with a dispenser opening of optional shape and with optional tearing means, for example a dispenser opening with tearing means all around the circumference of the opening. However because of the inwardly directed tearing means it is preferred that at least a part of the circumference of the dispenser opening is smooth and free from tearing means in order to avoid unintentional breaking of the paper during withdrawal from the dispenser.

The invention is of course not limited to the embodiments described above and shown in the drawings but it is understood that several modifications are possible within the scope of the claims.

The invention claimed is:

1. A dispensing system, comprising:

a roll of web material in a form of tissue paper or nonwoven material intended for wiping purposes, said roll having a roll diameter and a length and having an end surface at each end, said web material adapted to be unwound from the center of the roll through one end surface thereof;

a dispenser comprising an elongated housing for accommodating the roll, said housing having an end wall at each end covering the respective end surface of the roll, wherein a dispenser opening is arranged in at least one end wall of the dispenser, said dispenser opening being provided with a tearing device, said dispenser opening having an elongated shape having a length, a width and a pair of opposed side edges, wherein one side edge is provided with said tearing device and the opposite side edge is smooth and free from any tearing device, and wherein a length of the dispenser opening is between 50 and 90% of a roll diameter, a width of the dispenser opening is at least 10 times a thickness of the web material and the width of the dispenser opening is at least 5 mm but not more than 40 mm.

2. The dispensing system as claimed in claim 1, wherein the length of the dispenser opening is between 50 and 80% of the roll diameter.

3. The dispensing system as claimed in claim 1, wherein the width of the dispenser opening is at least 15 times the thickness of the web material and the width of the dispenser opening is at least 8 mm but not more than 30 mm.

4. The dispensing system as claimed in claim 1, wherein the dispenser opening including the tearing device lies in a same plane as the respective end wall, with tips of the tearing device being directed towards a center of the dispenser opening.

5. The dispensing system as claimed in claim 1, wherein the dispenser is portable and has a shape of a casing adapted to a size of the roll.

6. The dispensing system as claimed in claim 5, wherein said casing has a substantially cylindrical shape with a pair of plane end walls.

7. The dispensing system as claimed in claim 5, wherein at least a substantial part of the dispenser is made of a flexible material.

8. The dispensing system as claimed in claim 7, wherein said flexible material is a textile material and/or a plastic material.

9. The dispensing system as claimed in claim 5, further comprising a reclosable opening through which the roll of web material may be inserted into the dispenser, said reclosable opening being provided with an adhesive or a mechanical closure configured for closing the reclosable opening.

10. The dispensing system as claimed in claim 9, wherein said mechanical closure is selected from the group consisting of a zipper and hook-and-loop fasteners.

11. The dispensing system as claimed in claim 9, wherein said reclosable opening extends in a circumferential direction around at least 80% of the circumference of the dispenser at a distance of no more than 5 cm from an end wall thereof.

12. The dispensing system as claimed in claim 9, further comprising a carrying handle.

13. The dispensing system as claimed in claim 12, wherein said carrying handle extends in the longitudinal direction of the dispenser along a substantial part of the length thereof and a rigid strip is attached to flexible walls of the dispenser just opposite the carrying handle, said strip also extending in the longitudinal direction of the dispenser.

14. A dispensing system, comprising:

a roll of web material in a form of tissue paper or nonwoven material intended for wiping purposes, said roll having a roll diameter and a length and having an end surface at each end, said web material adapted to be unwound from a center of the roll through one end surface thereof; and a dispenser comprising an elongated housing for accommodating the roll, said housing having an end wall at each end covering the respective end surface of the roll, wherein a dispenser opening is arranged in at least one end wall of the housing, said dispenser opening being provided with a tearing device, said dispenser having a substantially cylindrical shape with two plane end walls and at least a substantial part of the dispenser is in the form of a casing made of a moisture and tear resistant flexible material adapted for multiple use, said dispenser further comprising a reclosable opening through which the roll of web material may be inserted into the dispenser, said reclosable opening extending in a circumferential direction around at least 80% of a circumference of the dispenser at a distance of no more than 5 cm from an end wall thereof and being provided with a refastenable adhesive or a mechanical closure configured for closing the reclosable opening, and the dispenser opening has an elongated shape having a length in a longitudinal direction and a width in a transverse direction and a pair of opposed longitudinal side edges, and wherein one longitudinal side edge is provided with said tearing device and the opposite longitudinal side edge is smooth and free from any tearing device, and wherein a length of the dispenser opening is between 50 and 90% of a roll diameter, a width of the dispenser opening is at least 10 times the thickness of the web material and the width of the dispenser opening is at least 5 mm but not more than 40 mm.

15. The dispensing system as claimed in claim 14, wherein said tear resistant flexible material is a textile material and/or a plastic material.

16. The dispensing system as claimed in claim 14, wherein said mechanical closure is selected from the group consisting of a zipper and hook-and-loop fasteners.

17. The dispensing system as claimed in claim 14, further comprising a carrying handle.

18. The dispensing system as claimed in claim 17, wherein said carrying handle extends in a longitudinal direction of the dispenser along a substantial part of a length thereof and a rigid strip is attached to the flexible walls of the dispenser just opposite the carrying handle, said strip also extending in the longitudinal direction of the dispenser.

19. The dispensing system as claimed in claim 14, wherein the length of the dispenser opening is between 50 and 80% of the roll diameter.

20. The dispensing system as claimed in claim 14, wherein the width of the dispenser opening is at least 15 times the thickness of the web material and the width of the dispenser opening is at least 8 mm but not more than 30 mm.

21. The dispensing system as claimed in claim 14, wherein the dispenser opening including the tearing device lies in the same plane as the respective end wall, with the tips of the tearing device being directed towards a center of the dispenser opening.

22. A dispensing system for tissue paper, comprising:

a roll of web material in a form of tissue paper, the web material having a basis weight between 10 and 100 $g/m^2$ and a thickness from 10 to 100 μm, the web material have a tensile strength below 800 N/m, said roll having a roll diameter and a length and having an end surface at each end, said web material adapted to be unwound from the center of the roll through one end surface thereof;

a dispenser comprising an elongated housing for accommodating the roll, said housing having an end wall at each end covering the respective end surface of the roll, at least 50% of the housing being formed from flexible material, wherein a dispenser opening is arranged in at least one end wall of the dispenser, said dispenser opening being provided with a tearing device including tearing teeth directed toward a center of the dispenser opening, said dispenser opening having an elongated shape having a length, a width and a pair of opposed side edges, wherein one side edge is provided with said tearing device and the opposite side edge is smooth and free from any tearing device, and wherein a length of the dispenser opening is between 50 and 90% of a roll diameter and a width of the dispenser opening is at least 10 times the thickness of the web material.

* * * * *